United States Patent [19]

Saito et al.

[11] 4,346,253

[45] Aug. 24, 1982

[54] COAXIAL CABLE

[75] Inventors: Yasunori Saito; Kunihiro Nakagaki; Kunihiko Yoneyama, all of Yokohama; Katsumi Ohmoto, Osaka, all of Japan

[73] Assignee: Sumitomo Electric Industries, Ltd., Osaka, Japan

[21] Appl. No.: 204,723

[22] Filed: Nov. 6, 1980

[30] Foreign Application Priority Data

Nov. 29, 1979 [JP] Japan ..... 54-166049[U]
Dec. 7, 1979 [JP] Japan ..... 54-170400[U]

[51] Int. Cl.[3] ..... H01B 11/18

[52] U.S. Cl. ..... 174/29; 174/102 D; 333/243

[58] Field of Search ..... 174/28, 29, 102 D, 106 D; 138/112, 114; 333/243, 244

[56] References Cited

U.S. PATENT DOCUMENTS 4,181,486 1/1980 Saito ..... 174/29 X

OTHER PUBLICATIONS

Andrew Catalog 24, "Antennas/Antenna Equipment/-Transmission Lines", Andrew Corporation, Claremont, California, U.S.A., copyright 1966, pp. 50, 52 and 54.

*Primary Examiner*—Laramie E. Askin
*Attorney, Agent, or Firm*—Sughrue, Mion, Zinn, Macpeak & Seas

[57] ABSTRACT

A coaxial cable which is highly flexible and in which bending causes very little change in electrical characteristics is disclosed. Inner and outer conductors, each provided as a corrugated tube, are arranged coaxially with a thermoplastic resin insulating member therebetween. The insulating member is composed of a spiral rib joined to an outer insulating tube. The spiral rib is made of high density polyethylene and the insulating tube of low density polyethylene. The ratio of the corrugation pitch of the inner conductor to the pitch of the outer conductor is in a range of 0.9 to 1.2.

3 Claims, 2 Drawing Figures

COAXIAL CABLE

BACKGROUND OF THE INVENTION

The present invention relates to a coaxial cable in which the inner and outer conductors are coaxially supported by a spiral insulating rib and an insulating tube is provided over the spiral insulating rib.

In a coaxial cable of this general type, it is necessary for the inner conductor to be able to sufficiently withstand the tension which is exerted thereon during the winding of the insulating rib. In order to satisfy this requirement, the inner conductor is provided as a metal tube having a large wall thickness or a solid metal wire. Therefore, the conventional coaxial cable is disadvantageous in that it is heavy, has a low bendability, and has a small bonding strength of the inner conductor and the insulating member.

SUMMARY OF THE INVENTION

In order to overcome these problems the invention provides a coaxial cable which has an improved bendability by employing corrugated metal tubes having a small wall thickness as the inner and outer conductors and by constructing the tubular part of the insulating member from soft, low density thermoplastic resin. The resulting structure has a high structural strength because the spiral insulating rib is made of rigid, high density thermoplastic resin, and for the same reason, has a high heat-resistance when used for power transmission.

A specific advantageous feature of the invention is that the ratio of the corrugation pitch $P_1$ of the corrugated inner conductor to the corrugation pitch $P_2$ of the corrugated outer conductor ranges from 0.9 to 1.2 ($0.9 \leqq P_1/P_2 \leqq 1.2$). It has been found that the bendability of a coaxial cable of the above-described type is remarkably improved by setting the corrugation pitch ratio in the above-described range. In one preferred embodiment, $P_1$ and $P_2$ are set equal and the pitch $P_3$ of the spiral rib is set to $P_1 \approx P_2 \approx (1/N)P_3$, where N is an integer.

DESCRIPTION OF THE PREFERRED EMBODIMENTS

Figure 1:
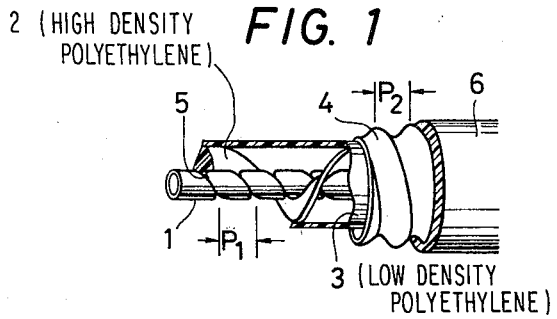
FIG. 1 is a sectional and partially cut-away view showing the interior of a coaxial cable according to the invention.

FIG. 1 shows a preferred embodiment of a coaxial cable constructed according to the invention. In FIG. 1, reference numeral 1 designates a tubular inner conductor having a small wall thickness and having a spiral groove of pitch $P_1$. A spiral insulating rib 2 formed of rigid, high density thermoplastic resin and a tube 3 of soft, low density thermoplastic resin are simultaneously extruded over the inner conductor 1 by an extruder in such a manner that the tube 3 is formed outside the insulating rib 2. The insulating rib 2 is trapezoidal or rectangular in section and has a spiral pitch of $P_3$. Immediately after extrusion, the inner surface of the tube 3 is fused to the outer surface of the insulating rib 2 to form an insulating member supporting the inner conductor coaxially. A metal tube is formed over the tube

3 supporting the inner conductor 1 and a spiral groove of pitch $P_2$ is formed on the metal tube. That is, an outer conductor 4 is formed on the tube 3. The direction of spiraling of the insulating rib 2 is opposite to those of the inner and outer conductors. The outer conductor 4 is covered with a protective sheath 6 made of plastic resin.

As is apparent from the above description, the tubular insulating member is formed as a single unit by extruding the insulating rib 2 and the tube 3 directly over the inner conductor 1. The structural stability of the cable is thereby remarkably improved. Especially, the spiral insulating rib 2 is formed in such a manner that it has a protrusion 5 which is positively fitted into the spiral groove of the inner conductor 1. Accordingly, the inner conductor 1 is firmly bonded to the insulating member while the insulating member is also firmly bonded to the outer conductor 4 through the insulating tube 3.

It is preferable that the insulating member be made of polyethylene which has excellent characteristics as a high frequency cable insulating material. For instance, when the cable is used for power transmission, heat is generated therein. However, if the insulating rib 2 in contact with the inner conductor 1 is made of high density polyethylene having a melting point higher than 130° C., the cable can sufficiently withstand the expected temperature rise. Furthermore, in this case the insulating rib 2 has a sufficiently high hardness and therefore the insulating rib 2 can be positively maintained in close contact with the inner conductor 1. Since the insulating tube 3 is in contact with the outer conductor 4 which is maintained at a temperature lower than the temperature of the inner conductor 1, low density polyethylene having a melting point of lower than 115° C. can be employed for forming the insulating tube 3. Such low density polyethylene improves the bendability of the cable.

As is clear from the above description, according to the invention, the insulating member is formed over the inner conductor by extrusion. Therefore, manufacture of coaxial cable according to the invention is advantageous in that no great force is exerted on the inner conductor, the coaxial cable has excellent bendability and is stable against the heat generated therein.

Figure 2:
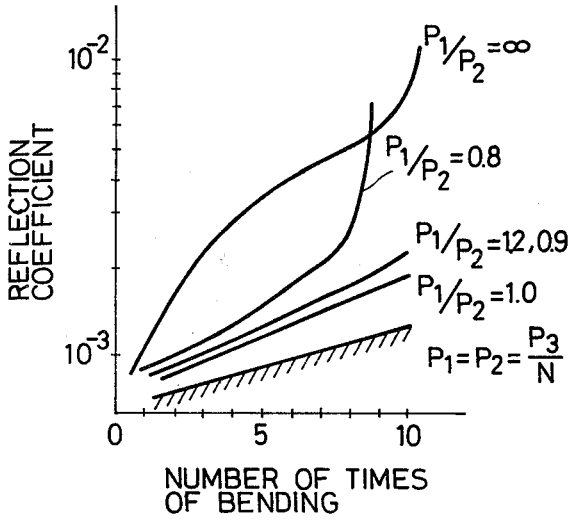
FIG. 2 is a graphical representation indicating the results of experiments conducted upon various coaxial cables according to the invention.

FIG. 2 is a graphical representation indicating the results of tests performed upon various examples of coaxial cable according to the invention. The pertinent data for the examples tested are as follows.

| | Outside diameter (mm) | Groove depth (mm) | Pitch (mm) | Tube wall thickness (mm) |
|---|---|---|---|---|
| Inner conductor | 15 | 1.5, 0 | $P_1$ = 8, 9, 10, 12, ∞ | 0.5 |
| Outer conductor | 40 | 2.5 | $P_2$ = 10 | 0.6 |
| Insulating member | 35 | — | $P_3$ = 38 | 1.0 |

In the cable tested, the rib was rectangular in section and had a thickness of 5.0 mm. In the table above, the inner conductor having a groove depth of zero was a straight tube having a wall thickness of 1.0 mm. The rib part and the tubular part of the insulating member were made of the same polyethylene material. The diameter of bending was 20 times as large as the outer diameter of the cable.

In FIG. 2, the vertical axis represents reflection coefficients while the horizontal axis represents the number of times of bending. As is apparent from FIG. 2, in the case of the coaxial cable in which the inner conductor is a straight tube, that is, $P_1/P_2=\infty$, the variation in impedance due to the bending is large although a large wall thickness was employed and, significantly, the reflection coefficient increased abruptly when the number of times of bending exceeded ten. For a coaxial cable having a pitch ratio $P_1/P_2=0.8$, the reflection coefficient was stable while the number of times of bending was relatively small but increased abruptly when the number of times of bending was about eight. However, for coaxial cables having pitch ratios $P_1/P_2$ of approximately 1.0, the reflection coefficients did not increase abruptly even when the number of times of bending exceeded ten. That is, the impedance did not change greatly.

Further, the same experiments were conducted by using various kind of cables having different spiral pitch $P_3$ with one another. According to the experiments, it was found that the most stabilized reflection efficiencies are obtainable to reduce impedance change due to bending under the following condition:

$$P_1 \approx P_2 \approx (1/N)P_3 \text{ (N: integer)}$$

The reflection coefficient can be provided within the hatching shown in FIG. 2. Therefore, desirable coaxial cable is obtainable relative to the bending by setting the corrugation pitch $P_1$ of the corrugated inner conductor substantially equal to the corrugation pitch $P_2$ of the corrugated outer conductor and by setting the spiral pitch $P_3$ of the insulation rib equal to an integer multiple of $P_1$ and $P_2$.

In summary, a coaxial cable which maintains stable characteristics against bending is obtained by setting the pitch ratio $P_1/P_2$ to 0.9 to 1.2. In addition, if the insulating rib and the insulating tube of the tubular insulating member are made of high density polyethylene and low density polyethylene, respectively, a coaxial cable is obtained which has even greater stability of electrical characteristic against bending and which has a high flexibility. That is, the coaxial cable can be bent with a smaller force. For instance, the required bending force is reduced to 80% of the force which is necessary to bend a coaxial cable in which all the insulating material thereof is high density polyethylene.

It is well known in the art that a coaxial cable having a corrugated inner conductor is more flexible and more stable against bending. In view of the above-described experimental results, it can be said that, among the factors relating to the inner and outer conductor corrugations, the most significant factor in the improvement of the bendability of coaxial cable formed as a compound member composed of an inner conductor, insulating member, outer conductor and protective sheath is the mutual relationship of the corrugation pitches of the inner and outer conductors and the spiral pitch of the insulation rib. In corrugating a metal tube, the relationship between the pitch and depth of corrugation is most important in determining the mechanical characteristics of the cable. Accordingly, this principle is applied to the manufacture of coaxial cable of the invention.

When the coaxial cable is bent, the inner conductor has a smaller curvature than the outer conductor. In addition, the inner conductor is smaller in size than the outer conductor. Accordingly, the inner conductor is more stable against mechanical deformation than the outer conductor. Thus, the corrugation pitch of the inner conductor may be larger than the corrugation pitch which was employed in prior art constructions. That is, the corrugation pitch for the inner conductor should be selected so that the inner conductor is mechanically stable against bending of the coaxial cable. Decreasing the corrugation pitch is not always effective in improving the bendability as it is also necessary to take into consideration the hardening which occurs in corrugation.

On the other hand, it should be noted that a coaxial cable is a compound member or composite structure. Therefore, making the corrugation pitches of the inner and outer conductors substantially equal to each other and making the spiral pitch of the insulation rib equal to an integer multiple of these corrugation pitches make it possible for the cable to undergo any bending motion satisfactorily. Thus, the bendability of the composite coaxial cable structure of the invention is quite excellent. That is, according to the coaxial cable which meets with the above conditions, in observing the cable along a longitudinal cross-section thereof, the inner and outer conductor portions in contact with the insulating rib have the same positional relationship among conductors and the rib, since $P_1$ is substantially equal to $P_2$ and $P_3$ is an integer multiple of $P_1$ or $P_2$. Therefore, if bending force is applied to the cable, the force is distributed into equal intervals at every pitch of the spiral rib (the force is dispersed), to generate minute deformation within the cable. In this case, the frequency characteristic of impedance is degraded in the band width, at which applied frequency is higher than the frequency whose half wave-length is equal to the pitch length of the insulation rib. As a result, realized is the coaxial cable having excellent bending characteristic yet having wide band width. On the other hand, according to the conventional coaxial cable of the type, since the pitch of the insulation rib $P_3$ is not an integer multiple of the corrugation pitches $P_1$, $P_2$ of the inner and outer conductors, stress concentrations are caused within the cable at every length corresponding to the least common multiple length defined by $P_1$, $P_2$ and $P_3$. In this regard, deformation is caused within the cable at every L. C. M. length each having a length larger than every pitch length of the insulation rib as in the subject invention. Therefore, the applied frequency degradation occurs at a lower frequency band width than that of the subject invention. Incidentally, if the pitch $P_3$ of the insulation rib is more than five times that of the corrugation pitches $P_1$, $P_2$ of the inner and outer conductors, the deformation of the inner and outer conductors in each pitch $P_3$ of the insulation rib is easily promoted when the bending radius of the cable is small.

What is claimed is:

1. A coaxial cable, comprising: inner and outer conductors, each of said inner and outer conductors being formed as a corrugated tube, and means for insulating and coaxially supporting said inner and outer conductors comprising a thermoplastic resin insulating member including a spiral rib and an insulating tube surrounding said rib, said spiral rib and said insulating tube being coupled together as an integral insulating member, said rib being in direct contact with said inner conductor and being closely fitted in bottoms of the corrugated portions thereof, said coaxial cable further comprising means for improving the bendability of the cable including spirally corrugated said inner and outer conductors with pitches $P_1$ and $P_2$, respectively, the ratio of said pitch $P_1$ to said pitch $P_2$ being in a range from 0.9 to 1.2, and said spiral rib being formed with a pitch $P_3$ wherein $$P_1 \approx P_2 \approx P_3/N,$$

where N is an integer.

2. The coaxial cable as claimed in claim 1 in which said spiral rib is made of high density polyethylene.

3. The coaxial cable as claimed in claim 1 in which said spiral rib is made of high density polyethylene and said insulating tube is made of low density polyethylene.

* * * * *